United States Patent [19]

Luo

[11] Patent Number: 5,027,759

[45] Date of Patent: Jul. 2, 1991

[54] FUEL INJECTION AND GASIFYING SYSTEM FOR TWO-STROKE ENGINE

[75] Inventor: Jih-Tzang Luo, Hsinchu, Taiwan

[73] Assignee: Industrial Technology Research Institute, Taiwan

[21] Appl. No.: 570,817

[22] Filed: Aug. 22, 1990

[51] Int. Cl.[5] ..... F02B 33/04

[52] U.S. Cl. ..... 123/73 PP; 123/279; 123/545

[58] Field of Search ..... 123/257, 279, 73 A, 123/73 B, 73 PP, 545, 548, 557, 193 P

[56] References Cited

U.S. PATENT DOCUMENTS

| | | | |
|---|---|---|---|
| 3,190,271 | 6/1965 | Gudmundsen | 123/73 B |
| 3,881,454 | 5/1975 | Jaulmes | 123/73 B |
| 4,708,100 | 11/1987 | Luo | 123/73 PP |
| 4,768,474 | 9/1988 | Fujimoto et al. | 123/73 B |
| 4,779,581 | 10/1988 | Maier | 123/73 B |
| 4,809,648 | 3/1989 | Luo | 123/73 PP |

*Primary Examiner*—David A. Okonsky

*Attorney, Agent, or Firm*—Flehr, Hohbach, Test Albritton & Herbert

[57] ABSTRACT

A fuel injection and gasifying system for an internal combustion engine is disclosed. The combustion system includes a piston assembly with a piston furnished with a gasifying chamber, a cylinder which contains the combustion apparatus, a crank assembly with a crankcase, an injection apparatus, and a control apparatus. The crank assembly manipulates the piston assembly between a first position and a second position. The injection apparatus delivers a fuel mixture to the combustion system, and is positioned such that, when the piston assembly is in the first position, the injection apparatus opens into the gasifying chamber, and when the piston assembly is in the second position, the injection apparatus opens into the crankcase. The control apparatus controls the operation of injection apparatus. When the temperature of the gasifying chamber is below the vaporizing temperature of the fuel the fuel is injected into the crankcase. Once the gasifying chamber has reached the vaporizing temperature, the fuel is injected into the gasifying chamber.

1 Claim, 1 Drawing Sheet

FUEL INJECTION AND GASIFYING SYSTEM FOR TWO-STROKE ENGINE

BRIEF DESCRIPTION OF THE INVENTION

The present invention relates generally to a fuel injection and gasifying system for a two-stroke internal combustion engine wherein the fuel nozzle is separated from the combustion chamber. More particularly, it relates to a fuel injection and gasifying system in which the fuel nozzle injects the fuel mixture into either a crankcase or a gasifying chamber in the piston, depending on the temperature of the system.

BACKGROUND OF THE INVENTION

U.S. Pat. No. 4,708,100 granted to applicant discloses a two-stroke engine which includes a fuel nozzle for injecting the fuel into a gasifying chamber in the piston so as to gasify the fuel before scavenging into the cylinder, thereby increasing the burning efficiency of the fuel. However, the fuel nozzle is exposed to the combustion chamber as a high heat environment. The high temperature may cause carbon deposits to form on the nozzle, which affects fuel metering. This, in turn, affects the fuel-air ratio, making it impossible to maintain a constant engine power output. An engine which separates the fuel nozzle from the area of ignition would reduce the formation of carbon deposits, making it possible to maintain a constant engine power output.

OBJECTS AND SUMMARY OF THE INVENTION

It is the general object of the present invention to provide a fuel injection and gasifying combustion system for a two-stroke engine.

Another object of the present invention is to provide a fuel injection and gasifying combustion system in which the fuel nozzle is separated from the combustion chamber.

A particular object of the present invention in to provide a fuel injection and gasifying system with a fuel nozzle which opens into either the gasifying chamber or the crankcase, depending on the positioning of the piston.

A more particular object of the present invention is to provide a fuel injection and gasifying combustion system in which the timing of the fuel nozzle operation is controlled such that the fuel mixture can be injected into either the gasifying or the crankcase.

The foregoing and other objects are achieved by a fuel injection and gasifying system with a piston assembly which includes a gasifying chamber, a cylinder forming a combustion chamber, a crank for transferring power from the piston assembly, a crankcase, an injection assembly for delivering fuel to the engine, and a control arrangement. The injection assembly is position such that it opens into the gasifying chamber when the piston assembly is in one position, and into the crankcase chamber when the piston is in a second position. The control arrangement causes the injection assembly to inject fuel into either the gasitying chamber or the crankcase.

BRIEF DESCRIPTION OF THE DRAWING

Other objects and advantages of the present invention will become apparent upon reading the following description and upon reference to the drawing, the single FIGURE of which is a sectional view of a fuel injection two-stroke engine in accordance with the present invention.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
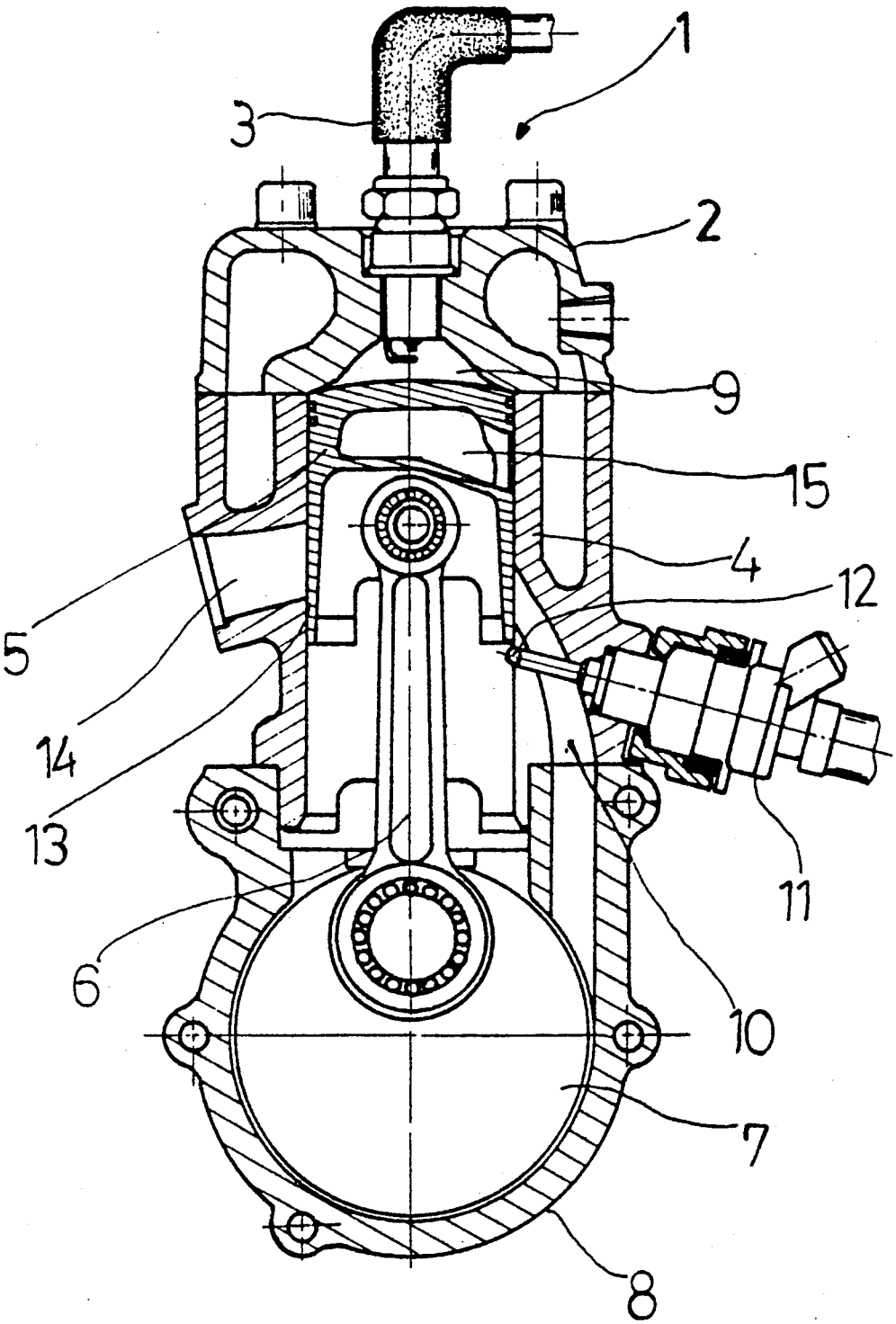

Referring to the FIGURE, a sectional view of an engine 1 is depicted. A spark plug 3 is secured in a cylinder head 2 which is mounted on top of a cylinder 4. A connecting rod 6 is affixed to a crank 7 which moves with piston 5 between top center and bottom center positions in cylinder 4. The piston 5 includes a skirt 13. A nozzle 11 delivers feed or a fuel-air mixture to engine 1 through an injection port 12. When piston 5 is in its top dead center position, the lower edge of skirt 13 is above injection port 12 which allows nozzle 11 to spray the fuel into a crankcase 8. When piston 5 is in the bottom dead center position injection port 12 opens into a gasifying chamber 15 in the piston 5. The area between the top of piston 5 and cylinder head 2 forms a combustion chamber 9.

When the engine has just been started or is idling, the piston is at a low temperature. A control means (not shown) causes nozzle 11 to inject the fuel while the piston 5 is at top dead center position and thus into crankcase 8 where it is mixed with air therein. When piston 5 moves down toward its bottom dead center position, the piston first clears communication between the combustion chamber 9 and an exhaust port 14 so that the gases of combustion are discharged. Shortly thereafter, the piston clears communication between some scavenging passages 10 and the combustion chamber 9 so that the fuel-air mixture heated in the crankcase 8 is forced through scavenging passages 10 and into combustion chamber 9 where it is ignited by spark plug 3.

After engine 1 has been operating for a period of time, the temperature of piston 5 will reach the vaporizing temperature of the fuel. During this stage of operation, the control means (not shown) causes nozzle 11 to inject the fuel into gasifying chamber 15 when piston 5 is at its bottom dead center position. The fuel vaporized in the gasifying chamber 15 will flow back into the scavenging passage 10 when the gasifying chamber 15 is aligned with the scavenging passage 10 upon the upward stroke of the piston 5. The gasified fuel is stored therein until the next scavenging step when it is blown into the combustion chamber 9 with compressed air from the crankcase 8 so as to form a fuel-air mixture that will be completely ignited. This prevents unburned fuel-air mixture, and toxic gases, from escaping through exhaust port 14, further improving the efficiency of engine 1.

As can be appreciated from the FIGURE and the above description, piston 5 always separates nozzle 11 from combustion chamber 9. Since nozzle 11 is never exposed to the combustion of the fuel-air mixture and the resultant high temperature, of combustion chamber 9, the formation of carbon deposits on nozzle 11 is prevented. This improves the operation of the engine and increases the life of the nozzle.

Thus, it is apparent that a fuel injection and gasifying system has been provided in accordance with the invention that satisfies the objects, aims, and advantages set forth above. While the invention has been described in conjunction with a specific embodiment, it is evident that many alternatives, modifications, and variations will be apparent to those skilled in the art in light of the foregoing description. Accordingly, it is intended to embrace all such alternatives, modifications and variations as fall within the spirit and scope of the appended claims.

What is claimed is:

1. A fuel injection and gasifying system for an internal combustion engine comprising:

(a) a piston assembly including a piston and a gasifying chamber formed therein;

(b) a cylinder including combustion chamber, an exhaust port and at least one scavenging port;

(c) crank means for manipulating said piston assembly between a first position and a second position, said crank means including a crankcase communicating with said scavenging port;

(d) injection means for selectively delivering fuel to one of said crankcase and said gasifying chamber, said injection means positioned such that, when said piston assembly is in said first position, said injection means opens into said gasifying chamber, and when said piston assembly is in said second position, said injection means opens into said crankcase; and (e) control means for controlling the operation of said injection means, such that, when the temperature of said gasifying chamber is below a vaporizing temperature of said fuel, said injection means delivers fuel to said crankcase and when said temperature of said gasifying chamber is above said vaporizing temperature, said injection means delivers fuel to said gasifying chamber, said gasifying chamber having an outlet which opens to said scavenging port and said injection means alternately upon movement of said piston assembly.

* * * * *